United States Patent [19]

Mori et al.

[11] 3,993,419

[45] Nov. 23, 1976

[54] APPARATUS FOR TENSIONING REINFORCEMENT IN A CONCRETE POLE MOLD

[75] Inventors: Takemitsu Mori, Hachioji; Toshio Tsunoda, Fujisawa; Shinzo Hasegawa, Kanagawa; Masao Tanaka, Kamakura, all of Japan

[73] Assignee: Nippon Concrete Industries Co. Ltd., Tokyo, Japan

[22] Filed: Dec. 30, 1974

[21] Appl. No.: 537,368

[52] U.S. Cl. ..... 425/111; 264/229

[51] Int. Cl.[2] ..... B28B 21/60

[58] Field of Search ..... 425/111; 264/228–229; 254/29 A

[56] References Cited

UNITED STATES PATENTS

| | | | |
|---|---|---|---|
| 3,162,709 | 12/1964 | Davidson | 425/111 |
| 3,583,047 | 6/1971 | Uchiyama | 264/228 |

FOREIGN PATENTS OR APPLICATIONS

| | | | |
|---|---|---|---|
| 1,459,366 | 1/1969 | Germany | 425/111 |
| 570,009 | 12/1957 | Italy | 254/29 A |

*Primary Examiner*—Francis S. Husar
*Assistant Examiner*—John McQuade
*Attorney, Agent, or Firm*—Oblon, Fisher, Spivak, McClelland & Maier

[57] ABSTRACT

This invention relates to an apparatus for tensioning reinforcements in the process of manufacturing concrete poles and the like having the structure in which a tension plate of a circular ring shape is fixed to an end plate for setting reinforcements placed inside a mold in a freely slidable manner, the inner surface of the tension plate is engaged with a jack rod, the outer periphery of the tension plate is provided with a plurality of protuberances whose thickness is less than that of the tension plate and which are spaced at equal intervals thereabout, a set ring of a circular ring shape is provided for contacting a flange part at the end of the mold, and the inner surface of the set ring is contacted with the outer periphery of the tension plate and has a plurality of concave parts into which the said protuberances can be disposed; and additional structure by which methods of engaging the tension plate with the jack rod and disengaging the plate from the rod are able to be accomplished in different ways.

7 Claims, 29 Drawing Figures

APPARATUS FOR TENSIONING REINFORCEMENT IN A CONCRETE POLE MOLD

SUMMARY OF THE INVENTION

This invention relates to an apparatus for tensioning reinforcements in the process of manufacturing concrete poles and the like. In case a prestressed concrete pole is manufactured by a centrifugal compacting method, reinforcements disposed inside a mold are required to be fixed in the mold under the tensioned condition. Hitherto an apparatus has been used in which a plate for setting reinforces which is connected with a jack rod is disposed inside a mold in a freely slidable manner, the plate has an engaging piece, and a plurality wedges are provided between the engaging piece and the mold end surface to keep the tensioning force at the time of tensioning the reinforcements. In such an apparatus after the curing is completed, the wedges are removed by striking the same from the outside. However the wedges are under high holding pressure because of the tension of the reinforcements. Therefore when the wedges are removed in order, the wedges which are removed later are subjected to a larger force and thereby the removal of the same is not easy. If they are removed by excessive striking many of them are damaged and cannot be used any more. Moreover since the attachment and the removal of the wedges are done by manual operation, there has been a problem that the operation is not efficient. The present invention is proposed in order to eliminate this problem.

The first feature of the present invention is in that a set ring of a circular ring shape which has a function the same as that of the wedge is provided at the end of a mold. By automatically turning the set ring with a motor or the like, a tension plate fixed to an end plate can be disengaged from the set ring. Therefore the attachment and the removal of wedges are all done automatically, and thereby it is possible to improve the working efficiency.

The second feature of the present invention is in that a jack rod can be freely engaged with and disengaged from the end plate for setting reinforcements and the engagement and the disengagement of the same can be done automatically according to the forward and rearward movement of the rod. For that reason a member adjacent to a chuck head at the forward of the jack rod is provided with a part which can protrude in the radial and circumferential direction. By automatically moving this member according to the movement of the jack rod, the jack rod can be engaged with and disengaged from the end plate. Therefore it is possible to automate the operation.

The other objects and features of the present invention will be apparent from some examples embodying the present invention described later according to the accompanying drawings.

BRIEF DESCRIPTION OF THE DRAWINGS

The accompanying drawings shown seven examples embodying the present invention;

FIG. 1 is a perspective view of a tension plate;

FIG. 2 is a perspective view of a set ring;

FIGS. 3 and 4 are vertical sectional views showing different conditions;

FIG. 5 is a vertical sectional view;

FIG. 6 is a sectional view taken along the line VI—VI of FIG. 5;

FIG. 7 is a partial enlarged sectional view;

FIG. 8 is a vertical sectional view showing the condition that reinforcements are tensioned and fixed;

FIG. 9 is a vertical sectional view;

FIG. 10 is an enlarged sectional view showing a main part of FIG. 9;

FIG. 11 is a partially cut front elevation view corresponding to FIG. 10;

FIG. 12 is a front elevation view showing the condition that a tension plate is engaged with a set ring;

FIG. 13 is an exploded sectional view of the engaged tension plate and set ring of FIG. 12, taken along the line XIII—XIII when they are apart;

FIG. 14 is a vertical sectional view;

FIG. 15 is an enlarged sectional view showing a main part of FIG. 14;

FIG. 16 is a front elevation view showing the condition of a tension plate engaged with a set ring;

FIG. 17 is an exploded sectional view of the engaged tension plate and set ring of FIG. 16 taken along the line XVII—XVII when they are apart;

FIG. 18 is a vertical sectional view;

FIG. 20 is a partially cut enlarged plan view corresponding to FIG. 19;

FIGS. 21, 22 and 23 are vertical sectional views showing different conditions;

FIG. 24 is a front elevation view showing the tension plate engaged with the set ring;

FIG. 25 is an exploded sectional view of the members of FIG. 24;

FIG. 26 is a vertical sectional view;

FIGS. 27 and 28 are enlarged sectional views showing different conditions; and FIG. 29 is a partial enlarged plan view.

DETAILED DESCRIPTION OF THE INVENTION

Figure 1:
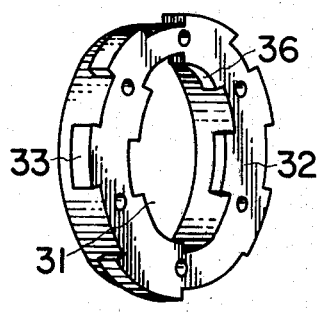
FIGS. 1 to 4 show the first embodiment.
Figure 2:
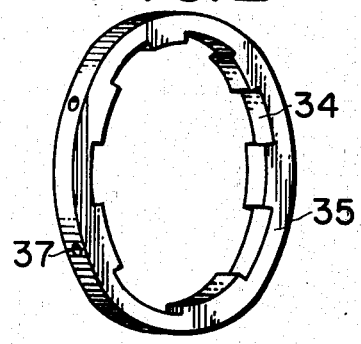

In FIGS. 1 to 4 showing the first embodiment of the present invention, a tension plate 32 is made by forming the circumference of a plate of a suitable thickness into a circle and making some protuberances 33 which thickness is about half of the thickness of the plate on the outer periphery at equal intervals. A hole 31 having protuberances 36 for engaging this plate with a jack is made at the inner central part of the tension plate 32.

A set ring 35 which is a circular ring-shaped plate has an inner diameter by which the inner surface of the set ring 35 can be contacted with the outer periphery of the tension plate 32 which is not provided with the protuberances 33. The inner surface of the set ring 35 is provided with concave parts 34 into which the protuberances 33 can be put and the outer periphery of the ring 35 is provided with suitable holes 37.

Figure 3:
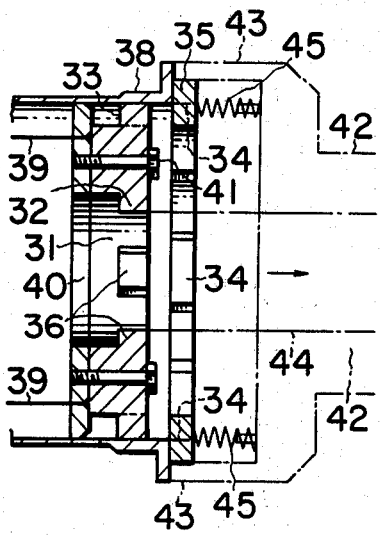

The present apparatus is used as described in the following. As shown in FIG. 3, the tension plate 32 is inserted into a mold 38 toward the inner side of the mold 38. Ends of reinforcements 39 for introducing prestress are directly attached to the tension plate 32, or as shown in the drawing, ends of reinforcements 39 are attached to an end plate 40 and the end plate 40 is joined with the tension plate 32 by bolts 41. The outer diameter of the set ring 35 is larger than the inner diameter of the mold 38, and the set ring 35 is supported by a coil spring 45 inserted inside a foot 43 of a jack 42.

Next the foot 43 of the jack 42 is contacted with the end surface of the mold 38, and a piston rod 44 of the jack 42 is engaged with the protuberances 36 in the hole 31 of the tension plate 32.

Figure 4:
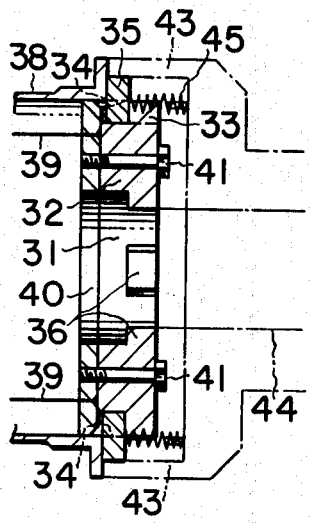
Figure 5:
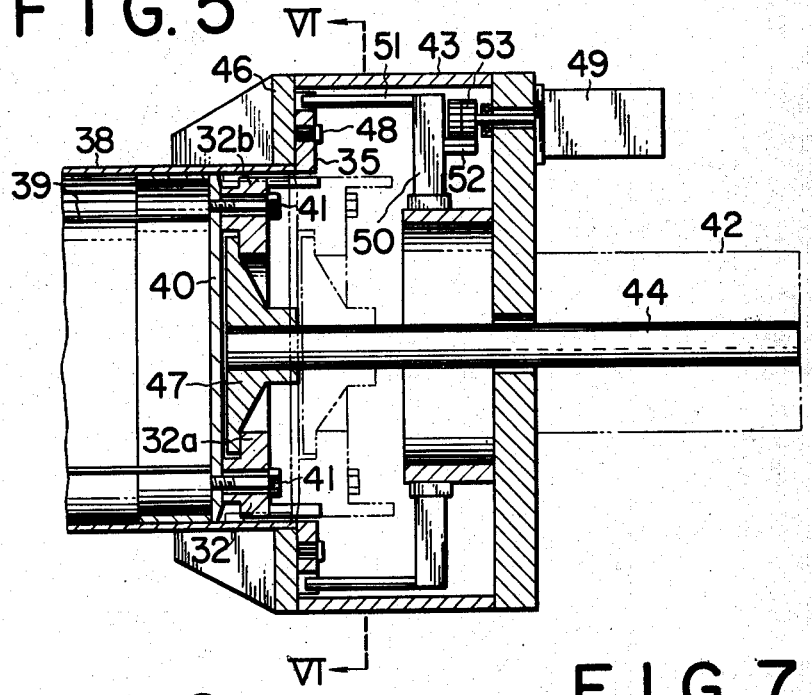
FIGS. 5 to 8 show the second embodiment.
Figure 6:
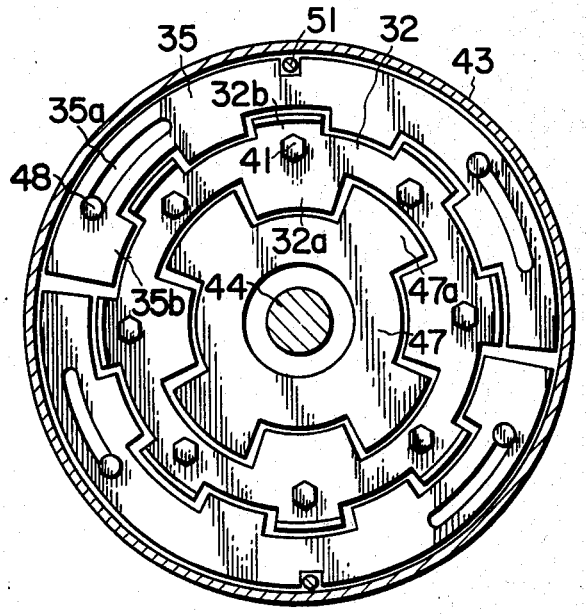

Subsequently the piston rod 44 is moved toward the outside of the mold 38 as shown by the arrow in FIG. 3 by operating the jack 42 to tension the reinforcements 39. In case the protuberances 33 of the tension plate 32 are consistent with the concave parts 34 of the set ring 35, since the set ring 35 is pressed by the coil spring 45, the set ring 35 is not moved and only the tension plate 32 is moved, and the set ring 35 is placed at the peripheral part of the tension plate 32 which is not provided with the protuberances 33 as shown in FIG. 4. At that time the movement of the piston rod 44 is stopped. A turning rod is inserted into one of the holes 37 formed on the outer periphery of the set ring 35 so as to turn the set ring 35 through a small angle so that the concave parts 34 of the set ring 35 are positioned at the concave parts between each protuberance 33 of the tension plate 32. Consequently the set ring 35 is placed between the end surface of the mold 38 and the protuberances 33 of the tension plate 32. Therefore even if the jack 42 is removed, the reinforcements 39 can be kept in the tensioned condition.

When the piston rod 44 is moved toward the outside of the mold 38 as shown by the arrow in FIG. 3 by operating the jack 42, in case the protuberances 33 of the tension place 32 are not consistent with the concave parts 34 of the set ring 35, the set ring 35 is pushed toward the jack 42 by the protuberances 33 of the tension plate 32. Therefore the turning rod is inserted into one of the holes 37 formed on the outer periphery of the set ring 35 in order to turn the set ring 35 so that the protuberances 33 of the tension plate 32 become consistent with the concave parts 34 of the set ring 35.

The tension plate 32 can be engaged with the piston rod 44 of the jack 42 by means of a screw.

According to the present embodiment, the set ring 35 is only disposed exteriorly of the tension plate 32 and does not blind the tension plate 32 from the outside. Therefore the set ring 35 can move easily along on the tension plate 32. Since the set ring 35 can be turned by a turning rod or the like from the outside of the foot 43 of the jack 42, the setting operation can be easily done without putting one's hands inside the foot 43, and therefore the apparatus is safe.

Figure 7:
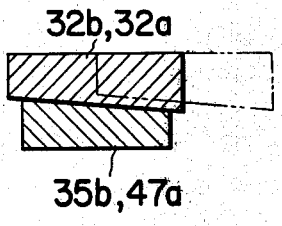
Figure 8:
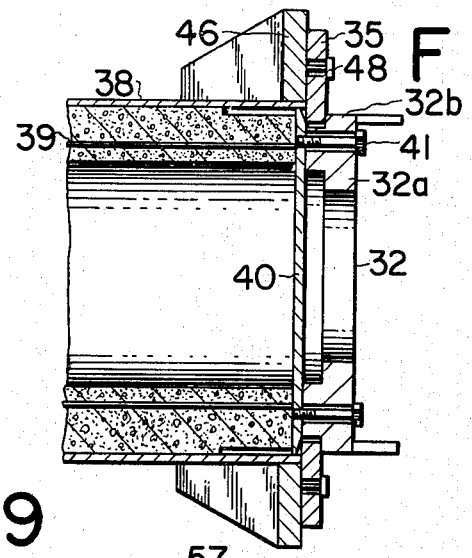
Figure 9:
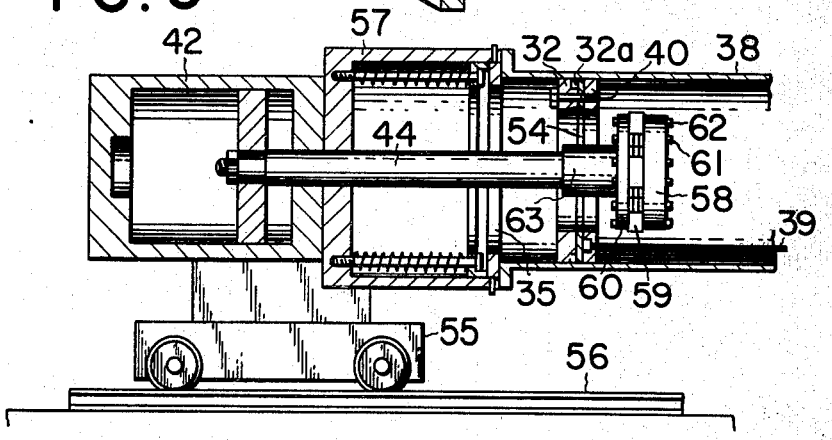
FIGS. 9 to 13 show the third embodiment.

In FIGS. 5 to 8 showing the second embodiment of the present invention, a flange 46 of a circular ring shape is attached to the outer periphery of the end of a cylindrical mold 38 for a concrete pole or pile. A cylindrical cover 43 having a jack 42 is attached to the flange 46. An end plate 40 for setting reinforcements 39 is provided for contacting the inner surface of the end of the mold 38 in a freely slidable manner. A tension plate 32 of a circular ring shape is fixed to a front peripheral part of the end plate 40 by bolts 41. The inner and outer surfaces of the tension plate 32 are provided respectively with engaging parts **32*a* and 32*b* at positions spaced apart from the end plate 40. A connecting plate 47 fixed to the forward end of a rod 44 of the jack 42 is attached to the end plate 40. The outer periphery of the connecting plate 47 is provided with a plurality of engaging parts 47*a* which are interposed between each inner engaging part 32*a* of the tension plate 32. In order to attach the connecting plate 47 to the end plate 40 in a freely removable manner, after the engaging parts 47*a* are disposed between each engaging part 32, the plate 47 is rotated somewhat so as to contact the parts 47*a* with the rear surfaces of the engaging parts 32*a*. In that case the contacting surfaces of the engaging parts 32*a* and 47*a* are formed into inclined planes parallel to each other for the smooth and secure engagement and disengagement of them as shown in FIG. 7. After this the jack rod 44 is connected with the end plate 40, if the jack 42 is operated, the end plate 40 is slid inside the mold 38, and thereby the reinforcements 39 can be tensioned. In that tensioned state, the set ring 35 attached to the flange 46 in a freely rotatable manner is engaged with the outer engaging parts 32*b*, so that the tensioned state can be kept. Namely the set ring 35 is provided with a plurality of slits 35*a* along its circumference. Pins 48 fixed to the flange 46 are inserted into the slits 35*a* so that the set ring 35 can be attached to the flange 46 in the freely rotatable manner. Further the inner surface of the set ring 35 is provided with engaging parts 35*b* which are disposed between each outer engaging part 32*b* of the tension plate 32. After the engaging parts 35*b* are disposed between each engaging part 32*b*, the set ring 35 is rotated somewhat so as to contact the engaging parts 35*b* with the rear surfaces of the engaging parts 32*b*, so that the movement of the end plate 40 is retained to keep the tensioned state of the reinforcements 39. In that case the contacting surfaces of the engaging parts 32*b* and 35*b* are also formed with inclined planes parallel to each other as shown in FIG. 7. The set ring 35 is engaged with pins 51 provided at suitable positions on a rotating plate 50 which is driven by a motor 49 and is turned by the working of the motor 49. The rotating plate 50 is driven through a rack 52 provided on the rotating plate 50 and a pinion 53 provided on a rotating shaft of the motor 49. In this case the rotating mechanism of the set ring 35** is not restricted to this embodiment, and it is also possible to directly rotate the same through other conveyance mechanisms, for example a gear mechanism.

For the operation of the present apparatus, after the reinforcements 39 are attached to the end plate 40, the connecting plate 47 of the jack rod 44 is connected with the end plate 40 as above-described, and the jack 42 is operated so as. When the end plate 40 is slid to the determined position tensioning the reinforcements 39, the motor 49 is operated so as to engage the engaging parts **32*b* of the tension plate 32 with the set ring 35 as above-described, so that the reinforcements 39 are kept in the tensioned state. In that state concrete is grouted inside the mold 38, and thereby a prestressed concrete pole or pile can be formed. In that case the cover 43 can be removed by disengaging the connecting plate 47 from the end plate 40**.

According to the present embodiment of the above structure, since the set ring 35 to be engaged with the end plate 40 is automatically operated by the motor 49, the attachment and the removal of set ring 35 can be automatically done, and thereby the working efficiency can be improved.

In FIGS. 9 to 13 showing the third embodiment of the present invention, inside a mold 38 for a concrete pole or pile there is disposed an end plate 40 of a circular ring shape to which the ends of a suitable number of reinforcements 39 arranged properly are fixed, and a wall-pressure regulating plate 54 and a tension plate 32 which are fastened with the end plate 40 as one body.

Figure 10:
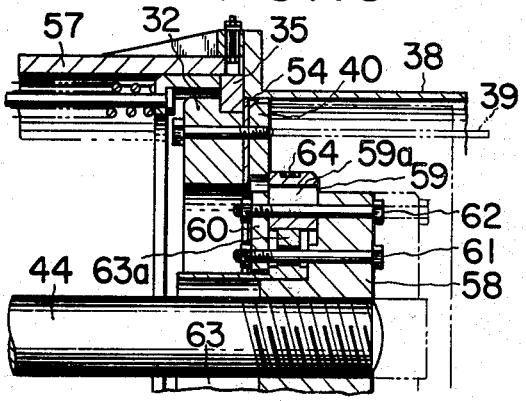

A jack 42 which is driven by oil pressure or the like is placed in front of the mold 38 so as to be coaxial therewith. The jack 42 can move on a rail 56 for a certain distance by means of a carriage 55. A jack supporter 57 is attached to the jack 42 on the side of the mold 38. A rod 44 to be thrust by the jack 42 passes through the jack supporter 57. A chuck head 58 of a flange shape which is to be inserted through the inner part of the tension plate 32 is fixed to the forward end of the rod 44 as one body. A plurality of chuck pieces 59 which slide in the radial direction relative to the axial core of the rod 44 are provided on the head 58 on the side of the jack 42. When the chuck pieces 59 slide outwardly, the forward ends of the chuck pieces 59 protrude beyond the outer diameter of the chuch head 58 and the inner diameter of the end plate 40. Further when the rod 44 is pulled back toward the jack 42, the chuck pieces 59 are engaged with the end plate 40 and the tension plate 32 as shown in FIG. 10 to pull these rewardly so as to tension the reinforcements 39.

A disc-shaped guide 60 is fixed to the chuck head 58 on the side of the jack 42 by bolts 61 and 62 leaving a space by which the sliding movement of the chuck pieces 59 is not disturbed. The bolts 62 are respectively inserted, through each slit 59*a* made on the chuck piece 59 in the direction perpendicular to the sliding movement piece 59, so that the chuck pieces 59 do not fall out of the position between the guide 60 and the chuck head 58. A cam 63 is attached to the chuck head 58 on the side of the jack 42 in a freely turnable manner. The cam 63 has pawls 63*a* corresponding to the number of the chuck pieces 59 and the chuck pieces 59 are moved by the pawls contacting them from the inside. Each pawl 63*a* has a slit 63*b* extending along its turning direction and the bolts 61 are respectively inserted through each slit 63*b*. Consequently, the pivotal extent of the cam 63 is regulated by the bolts 61.

Figure 11:
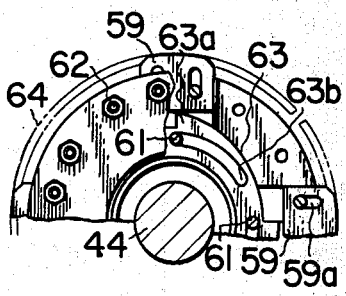

The pawls 63*a* change the contacting positions of the chuch pieces 59 and the cam 63 according to the rotating of the cam 63 as shown in FIG. 11. In the condition the contacting position is farthest from the axial core of the rod, the chuck piece 59 is in the most protruded position. A pushing unit 64 of a C-shaped steel band or the like for pushing all the chuck pieces 59 back toward the rod 44 is provided on the outer surfaces of the chuck pieces 59 so as to return the chuck pieces 59 according to the subsequent rotation of the cam 63.

Figure 12:
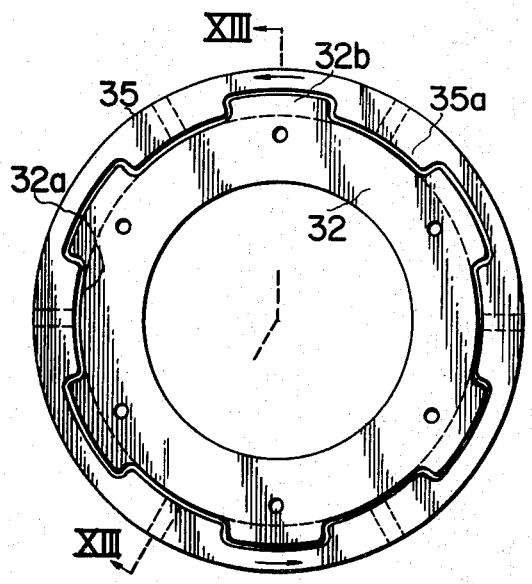
Figure 13:
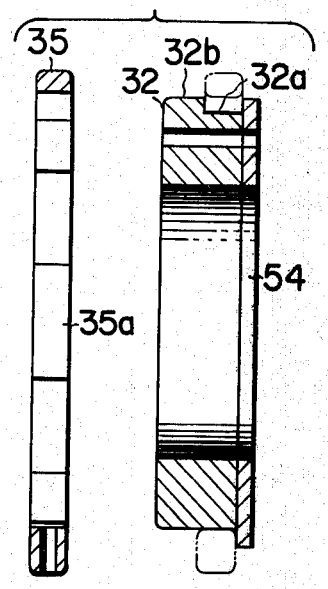

A set ring 35 is fixed to the end surface of a the jack supporter 57 on the side of the mold 38 in the freely removable manner. The width and the inner diameter of the set ring 35 correspond to concave parts 32*a* made on the outer periphery of the tension plate 32 as shown in FIGS. 12 and 13. Namely the outer surface of the tension plate 32 and the inner surface of the set ring 35 have respectively convex parts 32*b* and 35*a* to engage with each other which front shape is like a chrysanthemum. When the set ring 35 is disposed outisde the tension plate 32 at the position shown by a two-dotted line in FIG. 13, if the set ring 35 is turned through a predetermined angle, each convex part 32*b* engages with each convex part 35*a* toward the central axis.

The method of tensioning the reinforcements 39 in the present embodiment will be described hereinafter in the order of the process.

1. The jack supporter 57 having the set ring 35 at the end and the jack 42 are provided in the manner that they can move freely and they are coaxial with the mold 38 having the tension plate 32 inside. The end surface of the mold 38 is contacted with the end surface of the jack supporter 57 in the condition that the rod 44 is pushed forward as much as possible. The rod 44 is inserted into the mold 38 until the forward ends of the chuck pieces 59 pass through the inner part of the end plate 40 and protrude beyond the rear surface of the plate. (Refer to FIG. 9.)

2. The cam 63 is rotated so as to cause the protrusion of the chuck pieces 59 beyond the outer diameter of the chuck head 58 to the maximum extent and the rod 44 is pulled back by the jack 42. Therefore the chuck head 58 is moved from the position shown by the two-dotted line in FIG. 10 to the position shown by the solid line in the same figure. The rod 44 is pulled back further by the jack 42, so that the chuck pieces 59 contact the end plate 40 and the tension plate 32 is pulled out of the mold 38. The turning of the cam 63 can be automatically done by a gear mechanism or the like and also can be done manually by attaching a lever, a handle or the like to the cam.

3. When all of the concave parts 32*a* of the tension plate 32 are positioned outside the mold 38, since the set ring 35 is placed at the position corresponding to the concave parts 32*a*, if the set ring 35 is rotated through a predetermined angle (30° in the present embodiment), each convex part 32*b* is engaged with each convex part 35*a*. At this stage, even if the jack 42 is loosened, return movement of, the tension plate 32 for the reinforcements 39 is stopped at the end of the mold 38 through means of the set ring 35. Therefore the outer diameter of the set ring 35 should be larger than the inner diameter of the mold 38 at least.

4. In order to disengage the tension plate 32 from the chuck head 58, the rod 44 is pushed toward the mold 38 by the jack 42 to separate the chuck pieces 59 from the end plate 40, and the cam 63 is rotated in a reverse manner so that the chuck pieces 59 are returned toward the axial core by the pushing unit 64, and further the rod 44 and the carriage 55 are moved back, so that the whole tensioning apparatus is removed from the mold 38 with only the set ring 35 held in the concave parts 32*a* of the tension plate 32.

In the present embodiment of the above structure, the attachment and the removal of the jack can be done easily and surely, and the present apparatus is very effective to automate this operation. Moreover, because of the simple structure, there is an advantage that the manufacturing and assembling operation can be done easily and efficiently.

In FIGS. 14 to 17 showing the fourth embodiment of the present invention inside a mold 38 for a concrete pole or pile there is disposed an end plate 40 of a circular ring shape to which the ends of a suitable number of reinforcements 39 arranged properly are fixed, and a wall-pressure regulating plate 54 and a tension plate 32 which are fastened with the end plate 40 as one body.

A jack 42 is placed in front of the coaxial mold 38 in the manner. The jack 42 can move on a rail 56 for a certain distance by means of a carriage 55. A jack supporter 57 is attached to the jack 42 on the side of the mold 38. A rod 44 to be thrust by the jack 42 passes through the jack supporter 57. A guide 65 which is to be inserted through the inner part of the tension plate 32 is put on the rod 44 in a freely slidable manner. A plurality of chuck pieces 67 which forward ends have pawl parts are provided on the outer periphery of the guide 65 through means of brackets 66 in the manner that they can be freely turned through a predetermined angle. Each of the chuck pieces 67 is pressed by a spring 68 provided between the base of the chuck piece 67 and the outer surface of the guide 65 so that the forward end of the chuck piece 67 is always closed.

Figure 15:
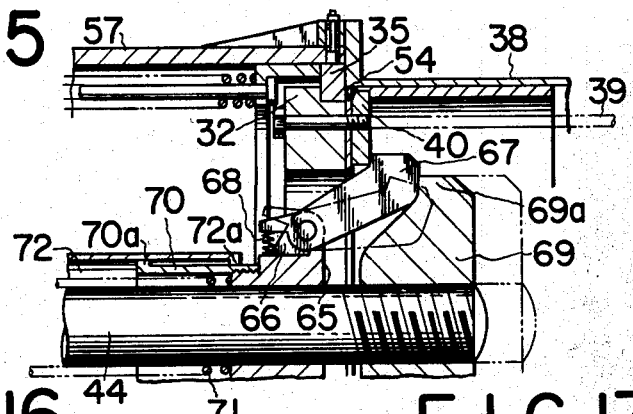

A taper head 69 is attached to the forward end of the rod 44 and opens and closes the chuck pieces 67 by the forward and backward sliding of the rod 44 as shown in FIG. 15. A flange 69*a* is formed at the end of the taper head 69. Namely, according to the forward and backward movement of the taper head 69, since the tapered surface of the head 69 contacts the rear side of the forward end of the chuck pieces 67, the chuck pieces 67 undulate radially relative to the rod 44 and the diameter of a circle made by connecting the forward ends of all of the chuck pieces 67 is made large and small. After the diameter is made larger at the inner side of the mold than that of the tension plate 32, if the rod 44 is pulled back by the jack 42, each chuck piece 67 is engaged with the tension plate 32 or the inner edge of the end plate 40 which is attached to the tension plate 32 on the inner side of the mold 38, and the tension plate 32 is pulled toward the jack 42 to give tension to the reinforcements 39.

Figure 16:
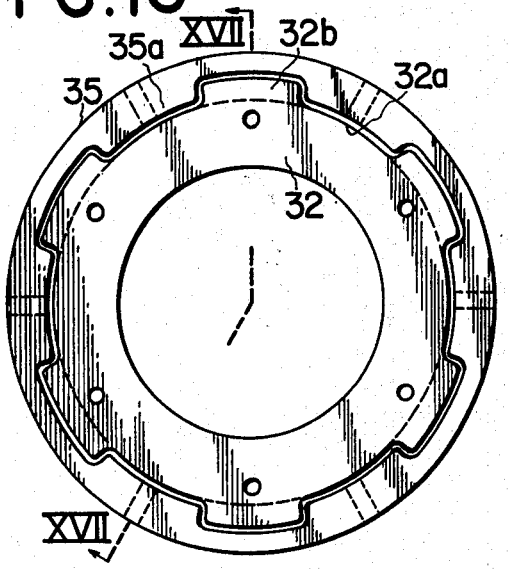
Figure 17:
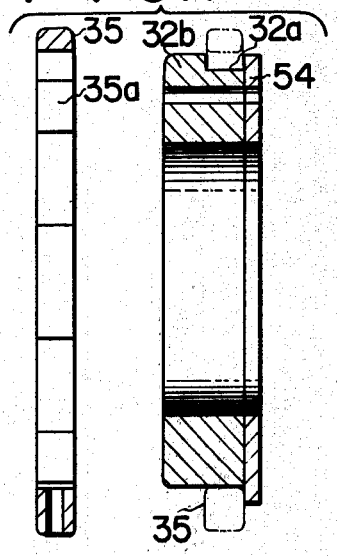

As shown in FIGS. 16 and 17, the tension plate 32 is formed into a chrysanthemum shape by having many convex parts 32*b* on the outer periphery on the side of the jacket 42, and concave parts 32*a* interposed between the wall-pressure regulating plate 54 provided between the tension plate 32 and the end plate 40 and the said convex parts 32*b*. The set ring 35 is fixed to the jack supporter 57 on the side of the mold 38 in a freely removable manner. The width and the inner diameter of the set ring 35 correspond to the concave parts 32*a* as shown in FIGS. 16 and 17. The inner surface of the set ring 35 has many convex parts 35*a* so that the front shape of the set ring 35 corresponds with the chrysanthemum shape of the tension plate 32. After the set ring 35 is put outside the tension plate 32, if the set ring 35 is rotated through a predetermined angle, each convex part 32*b* is engaged with each convex part 35*a* toward the rod 44.

A cylindrical stopper engaging part 70 is fixed to the base of the guide 65. A flange-shaped pawl 70*a* is formed at the end of the stopper engaging part 70 on the side of the jack 42. A spring 71 is inserted between the rod 44 and the inner surface of the stopper engaging part 70 so as to always push the guide 65 toward the mold 38. A cylindrical stopper 72 which is fixed to the jack supporter 57 is disposed outside the stopper engaging part 70. A stopper pawl 72*a* is formed at the forward inner end of the stopper 72. By the engagement of the pawl 72*a* of the stopper 72 with the pawl 70*a* of the stopper engaging part 70, the guide 65 cannot slide toward the mold 38 farther than the required distance.

The method of tensioning reinforcements in the above embodiment will be described hereinafter in the order of the process.

1. The jack supporter 57 having the set ring 35 at the end and the jack 42 are provided in the manner that they can move freely and are coaxial with the mold 38 having the tension plate 32 inside. The end surface of the mold 38 is contacted with the end surface of the jack supporter 57 in the condition that the rod 44 is pushed forward as much as possible. The rod 44 is inserted into the mold 38 until forward ends of the chuck pieces 67 pass through the inner part of the end plate 40 and protrude beyond the rear surface of the plate. (Refer to FIG. 14.)

2. The rod 44 is pulled back by the jack 42. Thereby the taper head 69 and the chuck pieces 67 are moved from the position shown by the a two-dotted line in FIG. 15 to the position where the chuck pieces are opened as shown by a solid line in the same figure. The rod 44 is pulled back further by the jack 42, so that the chuck pieces 67 are in contact with the end plate 40 and the tension plate 32 is pulled out of the mold 38. At this time the spring 71 is contracted.

3. When all of the concave parts 32*a* of the tension plate 32 are positioned outside the mold 38, since the set ring 35 is placed at the position corresponding to the concave parts 32*a*, if the set ring 35 is rotated through a predetermined angle (30° in the present embodiment), each convex part 32*b* is engaged with each convex part 35*a*. At this stage, even if the jack 42 is loosened, return movement of the tension plate 32 for the reinforcements 39 is stopped at the end of the mold 38 through means of the set ring 35. Therefore the outer diameter of the set ring 35 should be larger than the inner diameter of the mold 38.

Figure 14:
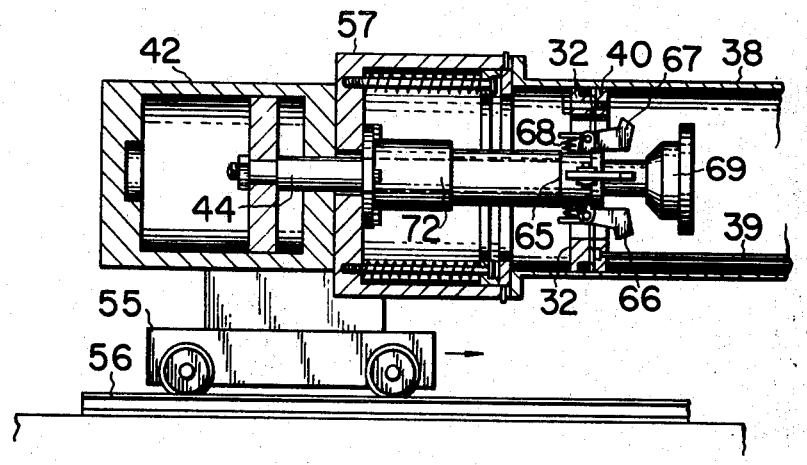
FIGS. 14 to 17 show the fourth embodiment.

4. In order to disengage the end plate 40 from the chuck pieces 67, the rod 44 is pushed toward the mold 38 by the jack 42 to close the chuck pieces 67 by means of the springs 68 as shown in FIG. 14. At that stage, if the carriage 55 is moved back, the whole tensioning apparatus is removed from the mold 38 with only the set ring 35 held in the concave parts 32*a* of the tension plate 32.

In the present embodiment, the attachment and the removal of the jack can be done easily and surely, and the present apparatus is very effective to automate this operation. Moreover, because of the simple structure, there is an advantage that the manufacturing and assembling operation can be done easily and efficiently.

Figure 18:
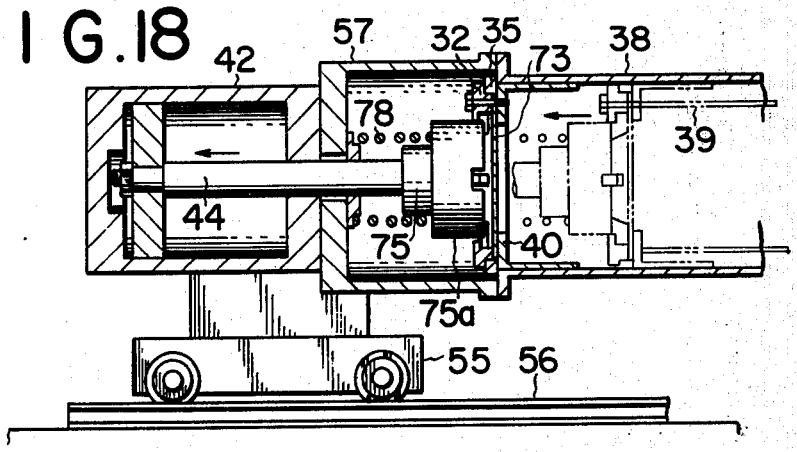
FIGS. 18 and 20 show the fifth embodiment.
Figure 19:
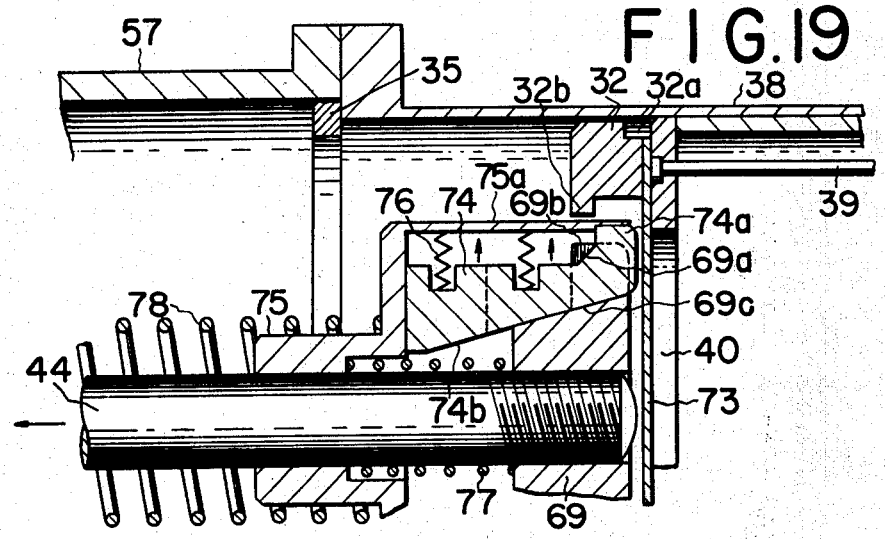
FIG. 19 is an enlarged sectional view showing a main part of FIG. 18.
Figure 20:
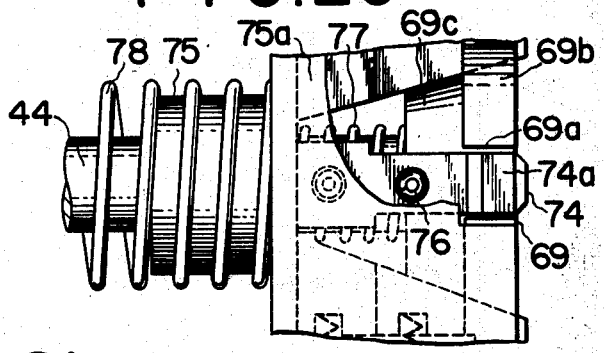
Figure 21:
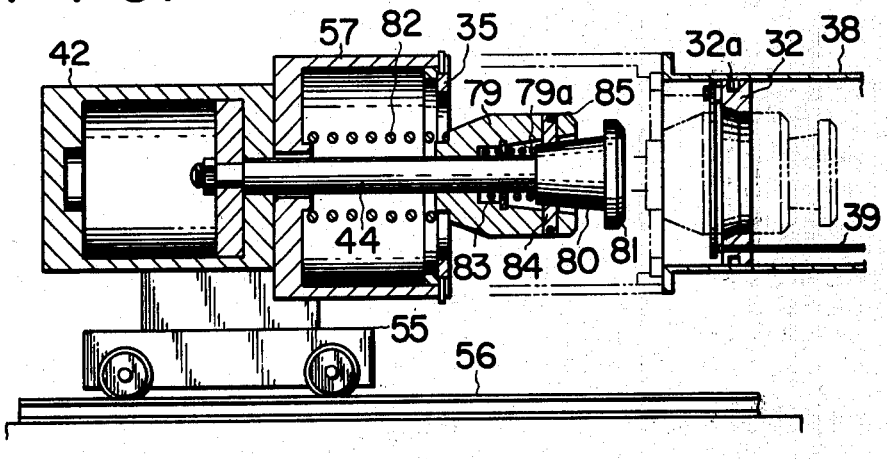
FIGS. 21 to 25 show the sixth embodiment.
Figure 22:
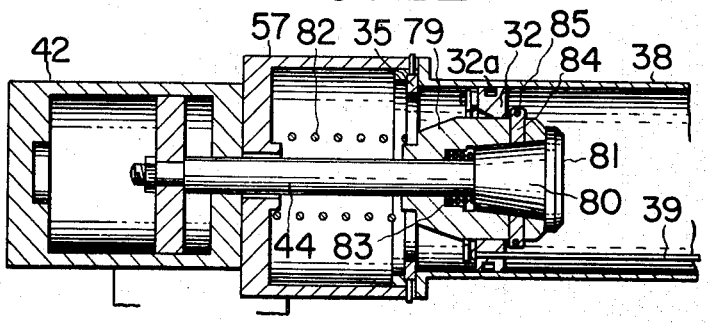
Figure 23:
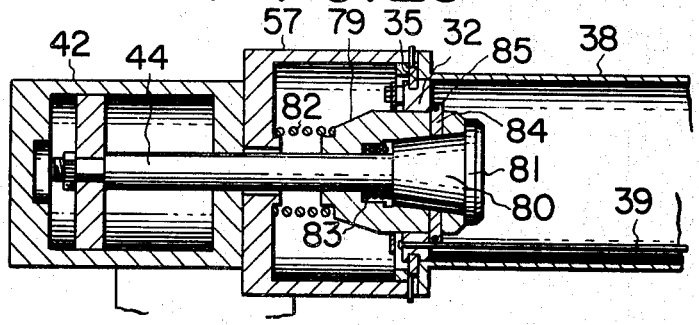

In FIGS. 18 to 20 showing the fifth embodiment of the present invention, inside a mold 38 for a concrete pole or pile there is disposed an end plate 40 of a circular ring shape to which the ends of a suitable number of reinforcements 39 arranged properly are fixed, a shutter plate 73 for separating the inner part (where concrete is filled up) and the outer part of the mold 38 and a tension plate 32 in the manner whereby all the plates are fastened with each other as one body.

A jack 42 is placed in front of the mold 38 in the manner so as to be coaxial therewith. The jack 42 can move on a rail 56 for a certain distance means of a carriage 55. A jack supporter 57 is attached to the jack 42 on the side of the mold 38. A rod 44 to be thrust by the jack 42 is inserted into the inner central part of the jack supporter 57. A chuck head 69 is attached to the forward end of the rod 44. The chuck head 69 is provided with a flange part 69*b* having concave parts 69*a* for supporting and guiding chuck pawls 74. The chuck pawls 74 can move radially by means of the chuck head 69. A guide 75 is provided on the rod 44 around the chuck head 69 on the side of the jack 42 in the manner that the guide 75 can slide on the rod 44. The chuck head 69 and the chuck pawls 74 are disposed inside the forward cylindrical part 75*a* of the guide 75. Springs 76 are provided between the outer surface of each pawl 74 and the inner surface of the cylindrical part 75*a* so as to always push the pawls 74 toward the rod 44. Each chuck pawl 74 is formed into a hook-shape so that the forward end 74*a* is engaged with the convex inner part 32*b* of the tension plate 32. Each chuck pawl 74 is disposed inside the concave part 69*a* formed on the outer periphery of the chuck head 69. The inner surface 74*b* of the pawl 74 has a predetermined inclination and is in contact with the tapered surface 69*c* of the chuck head 69.

A coil spring 77 is provided between the chuck head 69 and the guide 75, and another coil spring 78 is provided between the guide 75 and the inner rear end surface of the jack supporter 57. The elasticity of the springs 77 and 78 is set so that when the rod 44 pushed forward as much as possible is pulled back, first the spring 77 is compressed and next the spring 78 is compressed. Theset ring 35 is disposed inside the concave outer parts 32*a* of the tension plate 32 so as to hold the tension plate 32 at the end of the mold 38 by means of the tension given to the tension plate 32 through the reinforcements 39 in the direction of the inner side of the mold 38.

The tension plate 32 and the set ring 35 both have ring shapes. In order to facilitate the performance of the above setting operation, the inner periphery of the set ring 35 and the outer periphery of the tension plate 32 are formed into shapes, for example of a chrysanthemum, in which they correspond with each other so that if the set ring 35 is rotated through a predetermined angle after the set ring 35 is disposed outside the tension plate, they can be tightly engaged with each other.

The tensioning operation by the use of the apparatus of the present embodiment will be described hereinafter.

1. The jack 42 and the jack supporter 57 are provided in the manner that they can move freely and are coaxial with. Inside the mold 38 there is disposed the end plate 40 to which the ends of the reinforcements 39 are fixed and the tension plate which is fastened with the shutter plate 73 as one body which is closing the side of the jack 42 at the end plate 40. In the condition the rod 44 is pushed forward as much as possible, the carriage 55 is moved forward to the position where the chuck pawls 74 can be engaged with the convex inner part 32*b* of the tension plate 32. (Refer to FIG. 19.)

2. The rod 44 is pulled back by the jack 42 resisting the spring 77, so that the inclined surfaces 74*b* of the pawls 74 are contacted by the tapered part 69*c* of the head 69 and the pawls 74 are pushed outwardly, and thereby the forward ends 74*a* of the pawls 74 are engaged with the convex inner part 32*b* of the tension plate 32. Further the rod 44 is pulled back resisting the spring 78. Since the jack supporter 57 is contacting the end of the mold 38, the tension plate 32 is pulled toward the jack 42 getting the counter-force from the said contacting part and simultaneously the tension is imported to the reinforcements 39.

3. By the above operation of the jack 42, the tension plate 32 is pulled until the end surface of the end plate 40 is positioned at the end of the mold 38, and the tension plate 32 is set by means of the set ring 35 as shown by the solid line in FIG. 18 so as to maintain the tension.

4. In order to disengage the pawls 74 from the tension plate 32, first the rod 44 is pushed toward the mold by the pushing force of the spring 78, and next the rod 44 is pushed further by the pushing force of the spring 77. Consequently the head 69 and the pawls 74 are positioned as shown in FIG. 19 by means of the contacting inclined surfaces and the springs 76, so that the pawls 74 can be disengaged from the tension plate 32.

According to the present embodiment, the engagement and disengagement of the tension plate 32 and the pawls 74 and the tensioning operation for the reinforcements 39 can be done automatically by the change of the relative positions of the head 69 and the guide 75 due to the operation of the rod 44 by means of the jack 42. Moreover since, even if the central part of the end plate 40 is shut, such an operation can be done, there is an advantage that at the time of injecting concrete, cement does not leak out of the mold to the jack side.

In FIGS. 21 to 25 showing the sixth embodiment of the present invention, a ring-shaped tension plate 32 to which the ends of a suitable number of reinforcements 39 arranged properly are fixed is inserted inside a mold 38 for a concrete pole or pile.

A jack 42 is placed in front of the mold 38 so as to be coaxial therewith. The jack 42 can move on a rail 56 for a certain distance by means of a carriage 55. A jack supporter 57 is attached to the jack 42 on the side of the mold 38. A rod 44 to be thrust by the jack 42 is inserted into the inner part of the jack supporter 57. A guide 79 to be inserted through the tension plate 32 is disposed on the rod 44 in a freely slidable manner. A hollow part 79*a* of a predetermined tapered shape is formed at the inner part of the guide 79 on the side of the mold 38 so that a taper head 80 fixed to the forward end of the rod 44 can be disposed inside the hollow part 79*a*. A flange part 81 is formed at the forward end of the taper head 80. The flange 81 is in contact with the end surface of the guide 79 on the side of the mold 38 for maintaining a predetermined spacing between the periphery of the taper head 80 and the inner surface of the guide 79 in order to impart the tension of the jack 42 to the reinforcements 39.

The rod 44 is fixed to a piston provided inside the jack 42 and driven by oil pressure. A spring 82 is put on the rod 44 in the jack supporter 57 so as to always push the guide 79 toward the mold 38. Another spring 83 is disposed on the rod 44 inside the guide 79 so as to always push the guide 79 in the opposite direction of the mold 38 against the taper head 80. However the pushing force of the spring 83 is smaller than that of the spring 82.

A suitable number of chuck pieces 84 are provided so as to extend from the outer surface to the center of the guide 79 in a freely slidable manner, and the inner ends of the chuck pieces 84 are all in contact with the surface of the taper head 80. The outer ends of the chuck pieces 84 are provided with coil-ring shaped springs 85 for preventing each chuck piece 84 from slipping off the guide 79. By means of the springs 85 the chuck pieces 84 are also pushed back toward the inner side of the guide 79 after finishing the tensioning operation. Therefore each chuck piece 84 is disposed so as to be radially slidable in accordance with the movement of the taper head 80 so as to increase and decrease the outer diameter of a circle made by connecting the outer ends of the chuck pieces 84.

Figure 24:
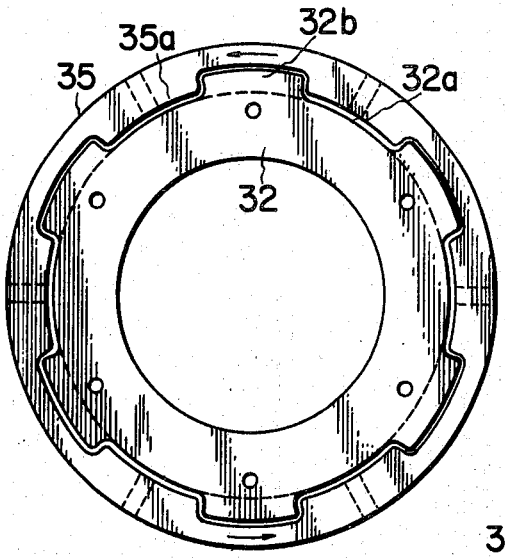
Figure 25:
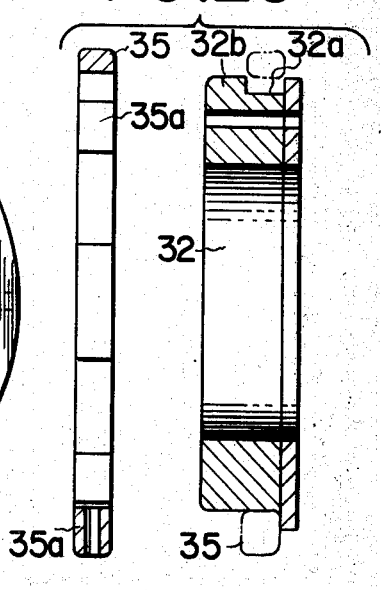
Figure 26:
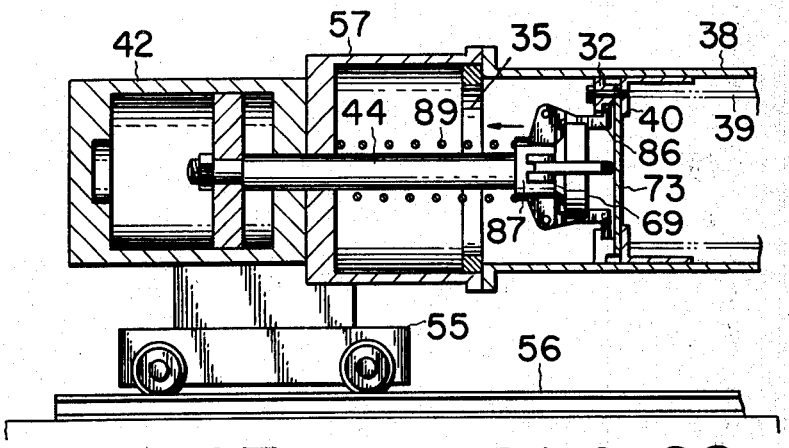
FIGS. 26 to 29 show the seventh embodiment.

A set ring 35 is fixed to the jack supporter 57 on the side of the mold 38 in a freely removable manner. The width and the inner diameter of the set ring 35 corresponds to the to concave parts 32*a* provided on the outer periphery of the tension plate 32 as shown in FIGS. 24 and 25. Namely the outer surface of the tension plate 32 and the inner surface of the set ring 35 are formed respectively into a chrysanthemum shape so that they can engage with each other. When the set ring 35 is disposed outside the tension plate 32 at the position shown by the two-dotted line in FIG. 24, if the set ring 35 is rotated through a predetermined angle, each convex part 32*b* of the tension plate 32 is engaged with each convex part 35*a* of the set ring 35.

The method of tensioning the reinforcements will be described hereinafter in the order of the process.

1. The jack 42 and the jack supporter 57 to which the set ring 35 is attached are provided in the manner that they can move freely and are coaxially disposed with the mold 38. Inside the mold 38 there is disposed the reinforcements 39 which ends are fixed to the tension plate 32. At this time the rod 44 is pushed toward the mold 38 as much as possible. (Refer to FIG. 21.)

2. Next, as shown by the two-dotted line in FIG. 21, the carriage 55 is moved toward the mold 38 until the end surface of the jack supporter 57 is in contact with the end surface of the mold 38. In that case the chuck pieces 84 should be positioned at the rear part of the tension plate 32.

3. Subsequently the rod 44 is pulled in the opposite direction of the mold 38 by the jack 42, so that the spring 83 which pushing force is weak is first compressed and the chuck pieces 84 are pushed radially to the outer side of the guide 79. (Refer to FIG. 22.)

4. The rod 44 is further pulled back by the jack 42, so that the end surface of the guide 79 is contacted with the flange 81 of the taper head 80 and the spring 82 is compressed. At this time the chuck pieces 84 protruded beyond the outer surface of the guide 79 are contacted with the rear surface of the tension plate 32 and the tension plate 32 is pulled toward the jack 42, and thereby the tension is given to the reinforcements 39.

5. When the tension plate 32 is protruded beyond the end surface of the mold 38 and the whole parts of the concave parts 32*a* of the tension plate 32 are placed outside the mold 38 at the position corresponding to the set ring 35 fixed to the end surface of the jack supporter 57, if the set ring 35 is turned by a certain angle, each convex part 32*b* of the tension plate 32 is engaged with each convex part 35*a* of the set ring 35 so that the tension plate 32 is stopped at the end of the mold 38. (Refer to FIG. 23.) In that case, the outer diameter of the set ring 35 should be larger than the inner diameter of the mold 38.

6. In order to disengage the tension plate 32 from the guide 79, the rod 44 is pushed toward the mold 38 by the jack 42 to the position shown by a two-dotted line in FIG. 21 and next the carriage 55 is moved in the opposite direction of the mold 38, so that the whole tensioning apparatus is removed from the mold 38 with only the set ring 35 held in the concave parts 32*a* of the tension plate 32.

The spring 83 provided inside the guide 79 is extended and contracted according to the movement of the rod 44, and even if the spring 83 is omitted, it does not affect the whole operation.

In the present embodiment, the attachment and the removal of a jack can be done easily and surely, and the present apparatus is effective to automate that operation. Since the shape and the structure of the chuck to be engaged at the time of tensioning the reforcements are simple, there is an advantage that the manufacturing and assembling operation can be done efficiently.

In FIG. 26 to 29 showing the seventh embodiment of the present invention, inside a mold 38 for a concrete pole or pile there is disposed a ring-shaped end plate 40 to which the ends of a suitable number of reinforcements 39 arranged properly are fixed, a shutter plate 73 for separating the inner part (where concrete is filled up) and the outer part of the mold 38 and a tension plate 32. All the plates are fastened with each other as one body.

A jack 42 is placed in front of the mold 38 so as to be coaxial therewith. The jack 42 can move on a rail 56 for a predetermined distance by means of a carriage 55. A jack supporter 57 is attached to the jack 42 on the side of the mold 38. A rod 44 to be thrust by the jack 42 is inserted into the inner central part of the jack supporter 57. A chuck head 69 is attached to the forward end of the rod 44. The chuck head 69 is provided with a flange part 69*b* having concave parts 69*a* for supporting and guiding chuck pawls 86. A guide 87 is provided on the rod around the chuck head 69 on the side of the jack 42 in such a manner that the guide can slide on the rod 44. The guide 87 is supporting the bases of the chuck pawls 86 through means of brackets in the freely rotatable manner. The chuck pawl 86 is formed into a hook-shape so that the forward end 86*a* is engaged with the convex inner part 32*b* of the tension plate 32. The chuck pawls 86 are attached to the outer periphery of the guide 87 and circumferentially thereabout in suitable numbers.

A coil spring 88 is provided between the chuck head 69 and the guide 87, and another coil spring 89 is provided between the guide 87 and the inner rear end surface of the jack supporter 57. The elasticity of the springs 88 and 89 is set so that when the rod 44 pushed forward as much as possible is pulled back, first the spring 88 is compressed and next the spring 89 is compressed. The set ring 35 is inserted into the concave parts 32*a* of the tension plate 32 so as to retain the tension plate 32 at the end of the mold 38 against the tension transmitted to the tension plate 32 through means of the reinforcements 39 in the direction of the inner side of the mold 38.

The tension plate 32 and the set ring 35 both have ring shapes. In order to enable the above setting operation, the inner periphery of the set ring 35 and the outer periphery of the tension plate 32 are formed into shapes, for example of a chrysanthemum, in which they correspond with each other so that if the set ring 35 is rotated through a predetermined angle after the set ring 35 is disposed outside the tension plate 32, they can be tightly engaged with each other.

The tensioning operation by the use of the apparatus of the present embodiment will be described hereinafter.

1. The jack 42 and the jack supporter 57 are provided in the manner that they can move freely and they are coaxial with the mold 38. Inside the mold 38 there is disposed the end plate 40 to which the ends of the reinforcements 39 are fixed and the tension plate fastened with the shutter plate 73 as one body which closes the side of the jack 42 at the end plate 40. In the condition the rod 44 is pushed forward as much as possible, the carriage 55 is moved forward to the position where the chuck pawls 86 can be engaged with the convex inner part 32*b* of the tension plate 32. (Refer to FIG. 28.)

2. The rod 44 is pulled back by the jack 42 resisting the spring 88, so that the lower central inclined surfaces 86*b* of the pawls 86 are in contact with the tapered part 69*c* of the head 69 whereby the pawls 86 are pushed outwardly, and thereby the forward ends 86*a* of the pawls 86 are engaged with the convex inner parts 32*b* of the tension plate 32. (Refer to FIG. 27.) Further the rod 44 is pulled back resisting the spring 89. Since the jack supporter 57 is in contact with the end of the mold 38, the tension plate 32 is pulled toward the jack 42, deriving the counterforce from the contacting part and simultaneously the tension is transmitted to the reinforcements 39.

Figure 27:
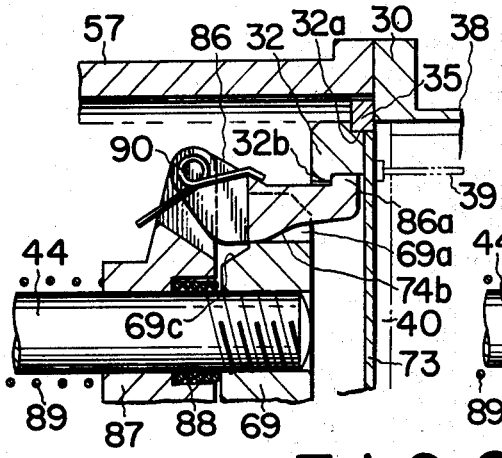

3. By the above operation of the jack 42, the tension plate 32 is pulled until the end surface of the end plate 40 is positioned at the end of the mold 38, and the tension plate 32 is set by the set ring 35 as shown in FIG. 27 to maintain the tension.

Figure 28:
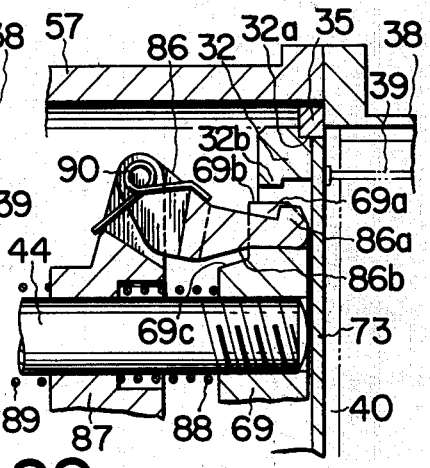
Figure 29:
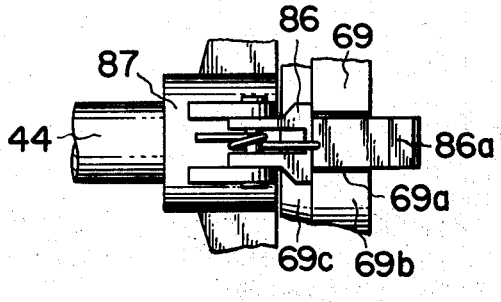

4. In order to disengage the pawls 86 from the tension plate 32, first the rod 44 is pushed toward the mold 38 by the pushing force of the spring 89, and next the rod 44 is pushed further by the pushing force of the spring 88. Thereby the rod 44 is in contact with the shutter plate 73. Thereafter if the carriage 55 is moved back under the condition that the rod 44 is pushed forward, the head 69 and the pawls 86 are positioned as shown in FIG. 28, so that the pawls 86 can be disengaged from the tension plate 32, and the pawls 86 are closed by the twisted coil or spring 90. Further the carriage 55 is moved back and the tensioning operation is finished.

According to the present embodiment, the engagement and the disengagement of the tension plate 32 and the pawls 86 and the tensioning operation of the reinforcements 39 can be done automatically by the change in the relative positions of the head 69 and the guide 87 due to the operation of the rod 44 by the jack 42. Moreover since, even if the central part of the end plate 40 is shut, such an operation can be performed, and there is an advantage that cement does not leak out of the mold to the jack side.

We claim:

1. An apparatus for tensioning reinforcements in the process of manufacturing concrete poles and the like comprising:

a tension plate, of a circular ring shape, fixed to an end plate which is, in turn, adapted to be fixed to reinforcements disposed interiorly of a circular mold in a freely slidable manner, the inner surface of the tension plate having protuberances which are cooperable with similar means of a piston rod driven by means of a jack, whereby said tension plate is engageable with and removable from said piston rod which is insertable and removable from said mold, the outer periphery of the tension plate also being provided with protuberances the thickness of which is less than that of the tension plate, said inner and outer protuberances being disposed at equal intervals about said tension plate, and a rotatable set ring of a circular ring shape spring biased, by means of said jack, into contact with a flange part formed at the end of the mold, the inner surface of the set ring being provided with protuberances, for contacting the outer protuberances of the tension plate, and concave parts through which said outer protuberances of said tension plate can be disposed so as to permit the set ring to pass by and around said tension plate, whereby said reinforcements may be tensioned and retained in said tensioned condition when said outer protuberances of said tension plate are aligned with and engage said inner protuberances of said set ring upon said set ring being rotated.

2. An apparatus for tensioning reinforcements in the process of manufacturing concrete poles and the like comprising:

a tension plate, of a circular ring shape, fixed to an end plate which is, in turn, adapted to be fixed to reinforcements disposed interiorly of a circular mold in a freely slidable manner, the inner surface of the tension plate having protuberances for cooperating with similar means of a connecting plate fixed to the forward end of a piston rod driven by means of a jack on the side of the mold, whereby said tension plate is engageable with and removable from said piston rod which is insertable and removable from said mold, the outer periphery of the tension plate also being provided with protuberances the thickness of which is less than that of the tension plate, and said inner and outer protuberances being disposed at equal intervals about said tension plate, a rotatable set ring of a circular ring shape rotatably secured to a flange part formed at the end of the mold, the inner surface of the set ring being provided with protuberances, for contacting the outer protuberances of the tension plate, and concave parts through which said outer protuberances of said tension plate can be disposed so as to permit said set ring to pass by and around said tension plate, and motor means connected to said set ring for rotating the same so as to align and engage said outer protuberances of said tension plate and said inner protuberances of said set ring for tensioning the reinforcements.

3. An apparatus for tensioning reinforcements in the process of manufacturing concrete poles and the like comprising:

a tension plate of circular ring shape fixed to an end plate which is, in turn, adapted to be fixed to reinforcements disposed interiorly of a circular mold in a freely slidable manner, the outer periphery of the tension plate being provided with protuberances the thickness of which is less than that of the tension plate, the protuberances being disposed at equal intervals about said plate, a rotatable set ring of a circular ring shape fixed to the end surface of a jack supporter attached to a jack on the side of the mold and in contact with a flange part formed at the end of the mold, the inner surface of the set ring being provided with protuberances, for contacting the outer protuberances of the tension plate, and concave parts through which said protuberances of said plate can be disposed so as to permit said set ring to pass by and around said tension plate, a piston rod inserted into the jack supporter and driven by means of said jack and having a chuck head at its forward end, the chuck head being provided with chuck pieces which slide radially relative to the rod and which protrude beyond the outer surface of the chuck head so as to be engaged with the inner surface of the tension plate, and cam means rotatably supported on said chuck head for biasing the chuck pieces radially outwardly for engaging said tension plate.

4. An apparatus for tensioning reinforcements in the process of manufacturing concrete poles and the like comprising:

a tension plate of a circular ring shape fixed to an end plate which is, in turn, adapted to be fixed to reinforcements disposed interiorly of a circular mold in a freely slidable manner, the outer periphery of the tension plate being provided with protuberances the thickness of which is less than that of the tension plate, the protuberances being disposed at equal intervals about said plate, a rotatable set ring of circular ring shape fixed to the end surface of a jack supporter attached to a jack on the side of the mold and in contact with a flange part formed at the end of the mold, the inner surface of the set ring being provided with protuberances, for contacting the outer protuberances of the tension plate, and concave parts through which said protuberances of said plate can be disposed so as to permit said set ring to pass by and around said tension plate, a reciprocable piston rod driven by means of said jack and having a taper head at its forward end inserted into the jack supporter, a guide disposed upon the piston rod in a freely slidable manner, the guide supporting chuck pieces which have pawl parts at the forward ends thereof, said chuck pieces being outwardly turned through a predetermined angle by contacting a tapered surface of said taper head when said head is moved backward, so as to engage the inner surface of the tension plate, and being closed by means of springs interposed between the bases of said pieces and the outer surface of said guide while they are not in contact with the taper head, whereby the diameter of a circle made by connecting the outer ends of the chuck pieces is made larger and smaller according to the movement of the taper head, and spring means for biasing the guide toward said taper head is interposed between the guide and the jack supporter.

5. An apparatus for tensioning reinforcements in the process of manufacturing concrete poles and the like comprising:

a tension plate of a circular ring shape fixed to an end plate which is, in turn, adopted to be fixed to reinforcements disposed interiorly of a circular mold in a freely slidable manner, the outer periphery of the tension plate being provided with protuberances the thickness of which is less than that of the tension plate, the protuberances being disposed at equal intervals about said plate, a rotatable set ring of a circular ring shape fixed to the end surface of a jack supporter attached to a jack on the side of the mold and in contact with a flange part formed at the end of the mold, the inner surface of the set ring being provided with protuberances, for contacting the outer protuberances of the tension plate, and concave parts through which said protuberances of said plate can be disposed so as to permit said set ring to pass by and around said tension plate, a reciprocable piston rod driven by means of the jack and having a taper head at its forward end inserted into the jack supporter, the taper head being provided with a flange part having concave parts on its outer periphery, the piston rod also being provided with a guide which has a cylindrical part at the forward end thereof for enveloping said head and which is freely slidable on the rod, a plurality of pawls having respectively spring means interposed between the outside thereof and said guide, and an inclined surface at the inside thereof, said pawls being interposed between the inner surface of said cylindrical part and the outer tapered surface of the taper head and being respectively disposed within said concave parts of said head so as to be engaged with and disengaged from the tension of said head so as to be engaged with and disengaged from the tension plate in response to the change of the relative positions between the guide and the taper head, and springs respectively interposed between the taper head and the guide and between the guide and the inner rear end of the jack supporter.

6. An apparatus for tensioning reinforcements in the process of manufacturing concrete poles and the like comprising:

a tension plate of a circular ring shape fixed to an end plate which in turn, adapted to be is fixed to reinforcements disposed interiorly of a mold in a freely slidable manner, the outer periphery of the tension plate being provided with protuberances the thickness of which is less than that of the tension plate, the protuberances being disposed at equal intervals about said plate, a rotatable set ring of a circular ring shape fixed to the end surface of a jack supporter attached to a jack on the side of the mold and in contact with a flange part formed at the end of the mold, the inner surface of the set ring being provided with protuberances, for contacting the outer protuberances of the tension plate, and concave parts through which said protuberances of said plate can be disposed so as to permit said set ring to pass by and around said tension plate, a piston rod driven by means of the jack and having a taper head at its forward end inserted into the jack supporter, a guide slidably disposed upon the piston rod under the influence of spring biasing means, the guide having a hollow part corresponding to said taper head for housing said head, a spring being disposed within said guide and between said guide and head for biasing the head, a plurality of chuck pieces radially slidable within said guide and which are adapted to be extended and contracted radially with respect to said guide according to the movement of the taper head so as to engage with and disengage from the inner surface of the tension plate, and springs provided at the outer ends of said chuck pieces so as to prevent said pieces from slipping off the guide and to push back the pieces when said pieces are disengaged from the taper head.

7. An apparatus for tensioning reinforcements in the process of manufacturing concrete poles and the like comprising:

a tension plate of a circular ring shape fixed to an end plate which is, adapted to be in turn, fixed to reinforcements disposed interiorly of a mold in a freely slidable manner, the outer periphery of the tension plate being provided with protuberances the thickness of which is less than that of the tension plate, the protuberances being disposed at equal intervals about said plate, a rotatable set ring of a circular ring shape fixed to the end surface of a jack supporter attached to a jack on the side of the mold and into contact with a flange part formed at the end of the mold, the inner surface of the set ring being provided with protuberances for contacting the outer protuberances of the tension plate, and concave parts through which said protuberances of said plate can be disposed so as to permit said set ring to pass by and around said tension plate, a piston rod driven by means of the jack and having a head at its forward end inserted into the jack supporter, a guide slidably disposed upon the piston rod under the influence of a spring biasing means, a spring interposed between said guide and head, the guide supporting the base portions of a plurality of pawls through means of brackets, the forward ends of the pawls being pushed outwardly so as to be engaged with the inner surface of the tension plate when the piston rod is pulled back so that the lower surfaces of the pawls are in contact with the tapered surface of said head, and twisted coil spring means operatively associated with said pawls for normally disengaging said pawls from said tension plate when said head is not in contact with said pawls, the pawls thus being engaged with and disengaged from the inner surface of the tension plate in response to the relative positions of the guide and the head.

* * * * *